US005653440A

United States Patent [19]

Nolan

[11] Patent Number: 5,653,440

[45] Date of Patent: Aug. 5, 1997

[54] BASEBALL BAT PRACTICE DEVICE

[75] Inventor: Timothy J. Nolan, Antioch, Ill.

[73] Assignees: Paul V. Smith, Sr.; Paul V. Smith, Jr., both of Lombard, Ill.; a part interest to each

[21] Appl. No.: 526,634

[22] Filed: Sep. 11, 1995

Related U.S. Application Data

[63] Continuation-in-part of Ser. No. 296,719, Aug. 26, 1994, Pat. No. 5,501,450.

[51] Int. Cl.[6] ..... A63B 69/00

[52] U.S. Cl. ..... 473/437

[58] Field of Search ..... 273/72 R, 72 A, 273/67 R, 26 R, 26 B, 29 A; 473/223, 256

[56] References Cited

U.S. PATENT DOCUMENTS 1,696,462 12/1928 Victor .
3,469,839 9/1969 Pietronuto et al. .
4,600,195 7/1986 Hunter .
4,634,121 1/1987 Sasaki .
4,768,785 9/1988 Patterson .
4,869,511 9/1989 Spoonster, Sr. .
4,898,386 2/1990 Anderson .
4,936,586 6/1990 Van Raemdonck .
5,178,394 1/1993 Tanampai .

*Primary Examiner*—Mark S. Graham
*Attorney, Agent, or Firm*—Meroni & Meroni

[57] ABSTRACT

A baseball bat practice device is provided for connection to a baseball bat with a knob at one end. The device includes a weight sized for positioning in co-axial assembly with the knob of the baseball bat. A plate member having an axial bore is provided. A bolt threadingly engages the bore of the plate member. A pair of annular members are attached to the plate member with the annular members extending away from the plate member in a crossed pattern and being positioned in engagement with axially facing surface areas of said knob of the baseball bat. The weight being removably connected to the bolt so that a user may selectively practice with a weight having a desired mass. The bolt, when rotated, exerting a pulling force against the pair of annular members engaged against the axially facing surface areas of the knob to hold the baseball batting training device in fixed engagement with the knob of said baseball bat.

20 Claims, 8 Drawing Sheets

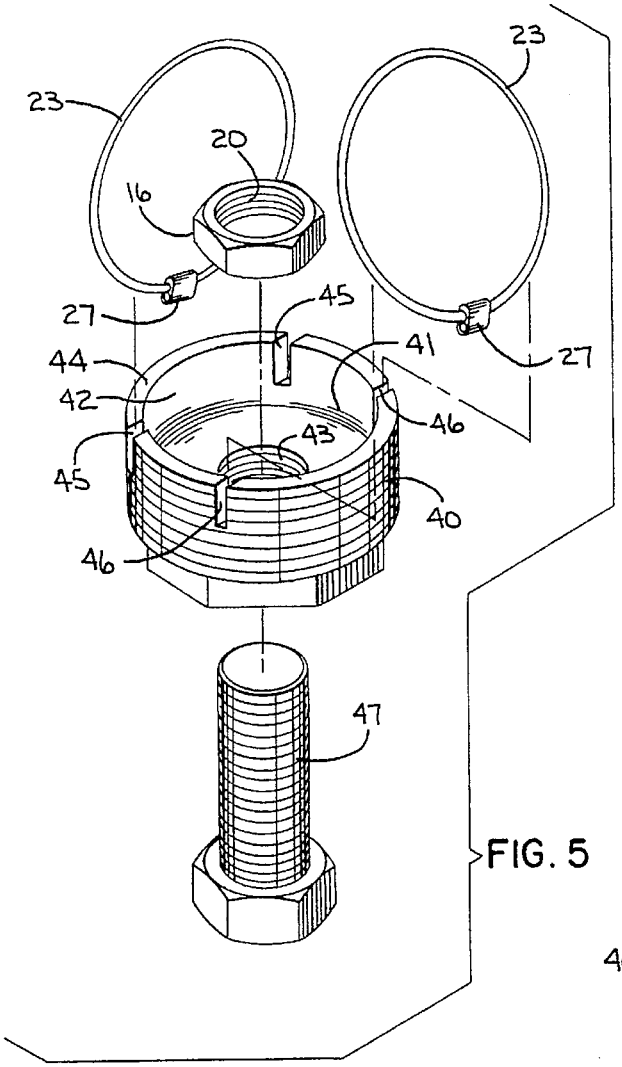
FIG. 5
FIG. 6
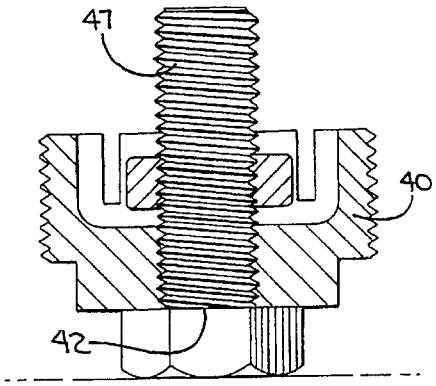
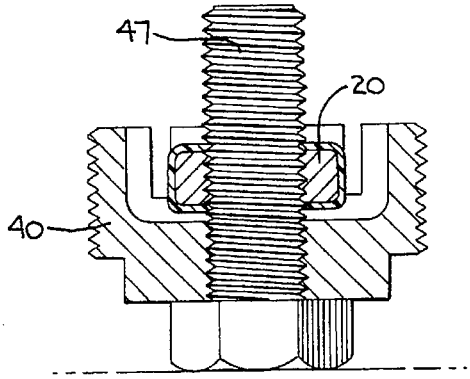
FIG. 7
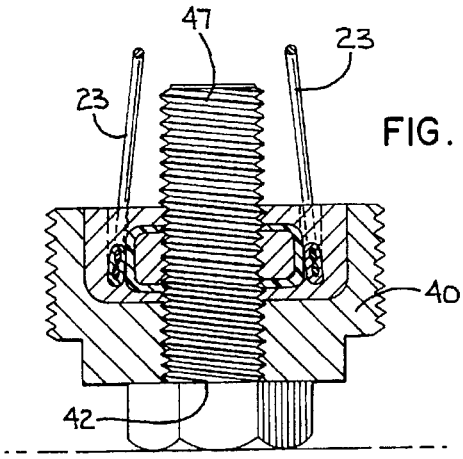
FIG. 8
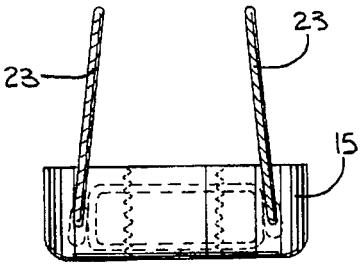
FIG. 9

Fig. 24
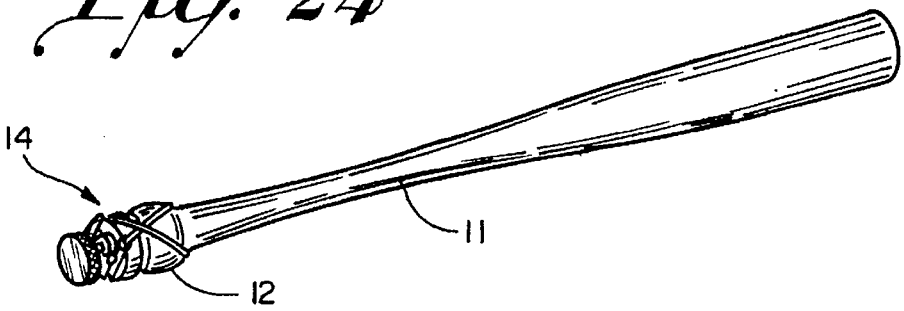
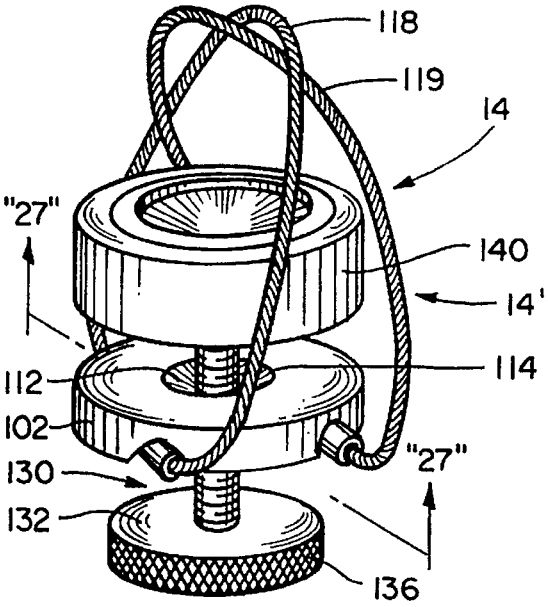
Fig. 25
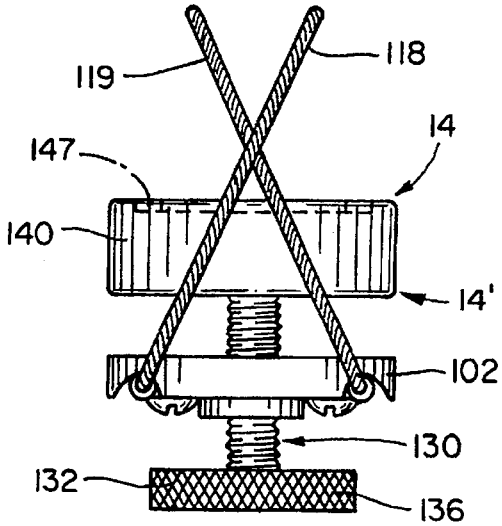
Fig. 26
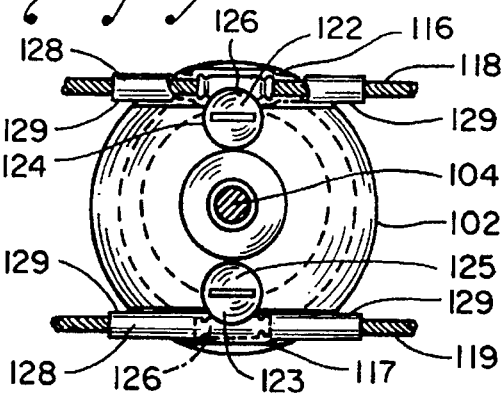
Fig. 27
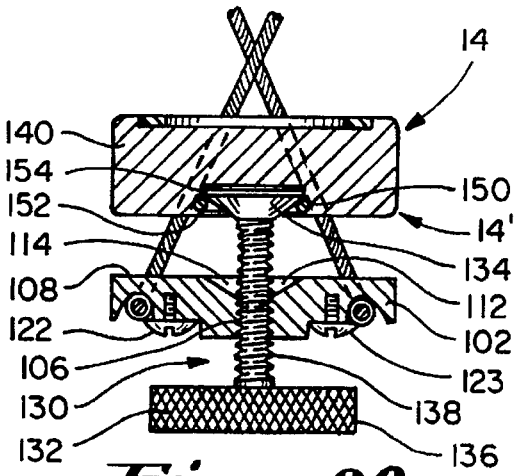
Fig. 28

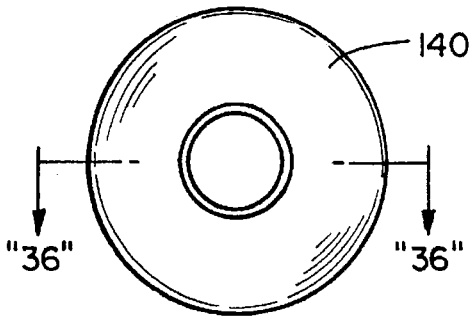
Fig. 35
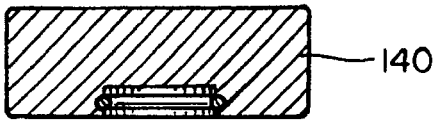
Fig. 36
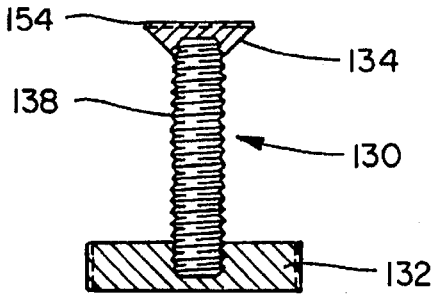
Fig. 37
Fig. 38
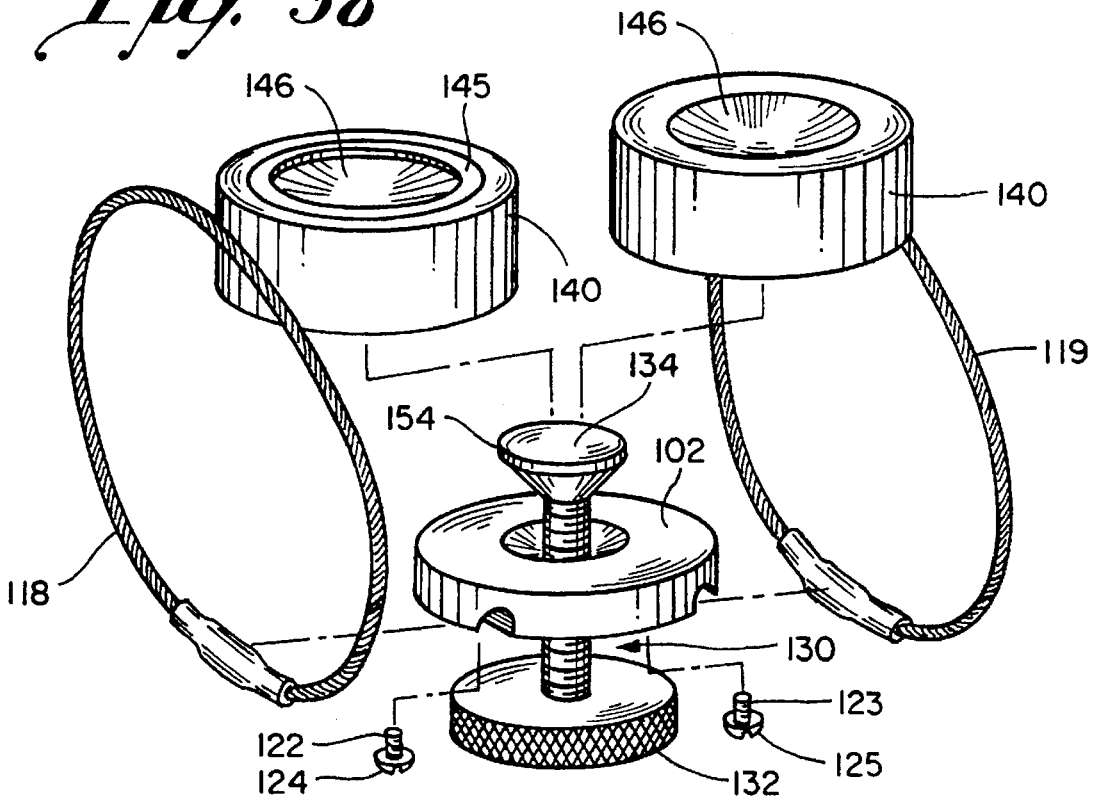

BASEBALL BAT PRACTICE DEVICE

This is a continuation-in-part application of application Ser. No. 08/296,719 filed on Aug. 26, 1994, now U.S. Pat. No. 5,501,450.

BACKGROUND OF THE INVENTION

1. Field of the Invention

The present invention relates generally to a baseball batting training device. More particularly, the present invention relates to a baseball batting training device that is mounted to a baseball bat and a method of manufacturing the same.

2. Description of the Prior Art

It is well known in the sporting world involving the game of baseball that a lot of practice is required for enabling a baseball player to develop a professional type of a power swing for driving a baseball at the highest possible velocity, even though, in certain instances it may be desired to alter the swing for, so called, bunts, hits to the opposite field and the like. The present invention is concerned with a baseball batting training device suitable for use in practice by a baseball player to aid in developing a more accurate and powerful swing.

In the past, certain types of weights have been used on a bat, such as metal members, to assist a player in warming up before entry into the batter's box. Other attachments to a baseball bat for training purposes have been used to teach a batter how to make a proper swing when trying to hit a ball. Still other types of baseball batting training devices have embodied a permanently modified baseball bat that audibly signals the batter when he or she is swinging the bat properly. Although these past uses are beneficial, there are still problems with them and they do not address the usage that is the subject of my invention.

The problem with past usage is the limitations inherent in their design. The past usage requires a specially designed baseball bat or permanently altered baseball bat. Thus, a batter can use the past training devices only as training devices and must have other regular bats to use when playing an actual baseball game. Further, where the bat is permanently altered, there is no easy way to return the bat to its original condition. Finally, the past usage only addresses improving a batter's swinging accuracy, rather than, addressing both swinging accuracy and, more importantly, the building up of the hand and arm muscles that a batter uses to swing the bat to produce a powerful swing.

Consequently, the past types of usage and features of a baseball batting training device differ from the one that is the subject of my invention. According to my invention, I have developed a baseball batting training device that is intended to be mounted at a knob end of an ordinary baseball bat and secured by a suitable means in such a way that the weight is located in coaxial alignment with the bat. This device is easily removable and does not permanently alter the baseball bat. The baseball batting training device functions to train the hand and arm muscles that do not get the same work out when using any of the existing baseball batting training devices. Thus ultimately, through training with the baseball batting training device a batter will be able to swing the ordinary baseball bat more accurately and powerfully, thus impacting an oncoming ball harder to make the ball go farther when it is hit.

SUMMARY OF THE INVENTION

In accordance with the present invention a baseball batting training device is provided. The device includes a structure mounted to a bolt for rotation therewith. The structure includes a weight sized for positioning in co-axial assembly with the knob of the baseball bat. A pair of annular members are attached to the structure. The annular members extending away from the structure in a crossed pattern with each other and being positioned in engagement with axially facing surface areas of said knob of the baseball bat. The bolt, when rotated, exerting a pulling force against the pair of annular members engaged against the axially facing surface areas of said knob to hold the baseball batting training device in fixed engagement with the knob of said baseball bat.

According to my present invention I have provided in combination, a baseball bat with a knob at one end, and a baseball batting training device comprised of a weight sized for positioning in co-axial assembly with the knob of the baseball bat. A plate member having an axial bore is provided. The bore having internal threads. A bolt with external threads is in threaded engagement with the internal threads of the bore. A pair of annular members are attached to the plate member with the annular members extending away from the plate member in a crossed pattern and being positioned in engagement with axially facing surface areas of said knob of the baseball bat. The weight being removably connected to the bolt so that a user may selectively practice with a weight having a desired mass. The bolt, when rotated, exerting a pulling force against the pair of annular members engaged against the axially facing surface areas of the knob to hold the baseball batting training device in fixed engagement with the knob of said baseball bat.

Another feature of my invention relates to the bolt having an enlarged head that can be manually turned to cause the external threads to move axially of the bore of the plate member for tightening the engagement of an upper surface of the weight against the knob. The bolt being rotatable in a reverse direction to release the tension between the weight and the knob end of the bat to enable the annular members to be progressively relieved of tension forces for allowing the crossed annular members to be detached from engagement with the knob of the baseball bat.

Another feature of my invention relates to the plate member having a pair of spaced apart grooves on a lower plate surface. The plate member has a pair of threaded screw bores disposed on the lower plate surface perpendicular and adjacent to respective grooves for receiving a pair of mounting screws. The mounting screws having screw heads extending over a respective groove in pressing engagement with a respective annular member.

Other objects, features and advantages of the invention will become more readily apparent upon reference to the following description when taken in conjunction with the accompanying drawings, which drawings illustrate several embodiments of the invention.

BRIEF DESCRIPTION OF THE DRAWINGS

FIG. 5 is an exploded view of a die for forming the first embodiment of a baseball batting training device shown with several components of the baseball batting training device;

FIG. 6 is a cross section view of the selected components of the die shown in assembled relation and with a die bolt shown in elevation;

FIG. 7 is a enlarged partially cross sectioned view similar to FIG. 6;

FIG. 8 is an enlarged partially cross sectioned view similar to FIGS. 6 and 7 only with the annular members being shown embedded in the material poured into the die;

FIG. 9 is an enlarged side view of a cast part of my baseball batting training device prior to the assembly of the threaded bolt therewith as seen in FIG. 2;

FIG. 12 is a top plan view of the blank in FIG. 11 only having a threaded screw hole drilled there through;

FIG. 20 is a side view of a circular blank of steel for use in the manufacture of a third embodiment of my baseball batting training device, with a screw hole for engaging a set screw drilled there through;

FIG. 24 is a perspective view of my new combination including a baseball bat and the fourth embodiment of my baseball batting training device mounted on a knob of a bat;

FIG. 25 is a perspective view of the fourth embodiment of my baseball batting training device shown in FIG. 24;

FIG. 26 is a side view of the baseball batting training device shown in FIG. 24;

FIG. 27 is bottom view of a plate of the fourth embodiment with annual members mounted thereto;

FIG. 28 is a sectional view of the baseball batting training device taken on the line 28—28 as shown in FIG. 25;

FIG. 35 is a bottom view of the weight of the fourth embodiment;

FIG. 36 is a sectional view of the weight taken along line 36—36 of FIG. 35;

FIG. 37 is partial sectional view of the bolt of the fourth embodiment; and

FIG. 38 is an exploded disassembled view of the baseball batting practice device of the fourth embodiment showing interchangeable weights that may be selectively secured to the device.

DETAILED DESCRIPTION OF THE PREFERRED EMBODIMENT

Figure 1:
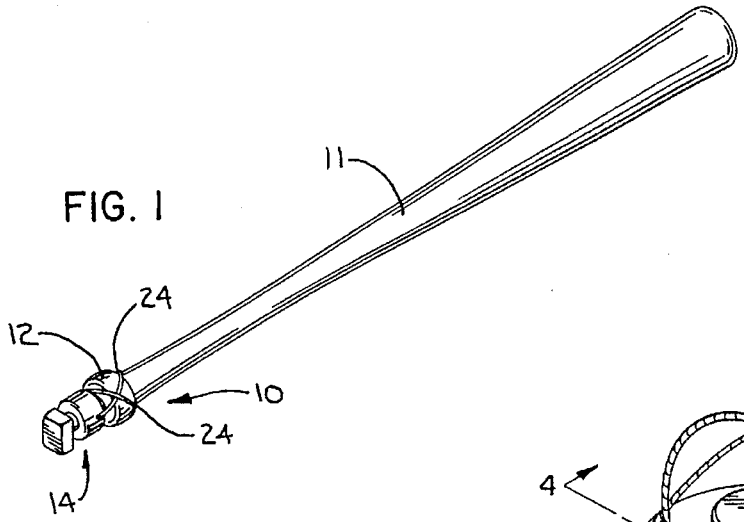
FIG. 1 is a perspective view of my new combination including a baseball bat and the first embodiment of my baseball batting training device mounted on a knob of a bat.

My invention contemplates a new and improved combination 10, which includes a baseball bat 11 having a knob 12 at one end and a baseball batting training device or baseball bat practice device 14, as shown in FIG. 1. It is contemplated that this training device 14 can be easily attached and removed from a knob end of the bat 11 by the user. It is further contemplated that the baseball training device 14 also has inventive features apart from the combination as a training device which can be marketed through sporting outlets for purchase by the public at large.

Referring now to the drawings, the device 14 generally includes a structure 14' mounted to a bolt for rotation therewith. The structure 14' includes a weight sized for positioning in co-axial assembly with the knob of the baseball bat. A pair of annular members are attached to the structure 14'.

Referring now to FIGS. 2–9, the training device 14 contains a weight 15 that is sized for positioning in coaxial assembly with the knob 12 of the baseball bat 11. Preferably, the weight is formed of metal, however, it is to be understood that plastic Teflon, porcelain or any other type of suitable material may be used. It is contemplated that the training device weight can range in size from one to thirty-two ounces, as desired. Excellent results can be obtained where the training device has a weight of approximately fourteen ounces for adult use and eight ounces for children's use. In this embodiment, the weight 15 itself is preferably comprised of lead with certain components having been cast and formed integral with the weight 15. To this end, the weight 15 is so formed as to be provided with and internally threaded with a steel nut 16. This nut is comprised preferably with a hard metal which is harder than lead so as to provide threads 20 which have an extended life. The weight 15 has a bolt bore 18 which extends coaxial out of a threaded bore 19 provided in the threaded nut 16. The threads 20 are provided internally of the bore 19 for coaction with a bolt 21. The bolt 21 has external threads 22 that are threadingly engageable with the threads 20 in the threaded nut 16.

Figure 2:
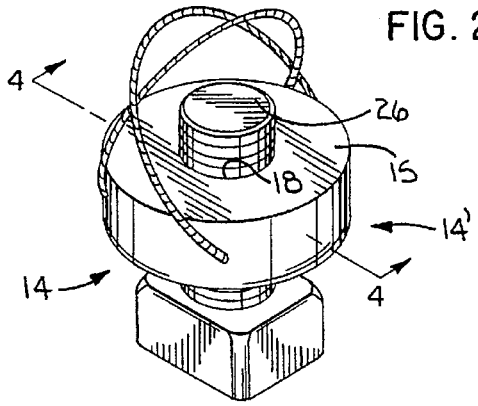
FIG. 2 is an enlarged perspective view of the first embodiment of my baseball batting training device shown in FIG. 1.
Figure 3:
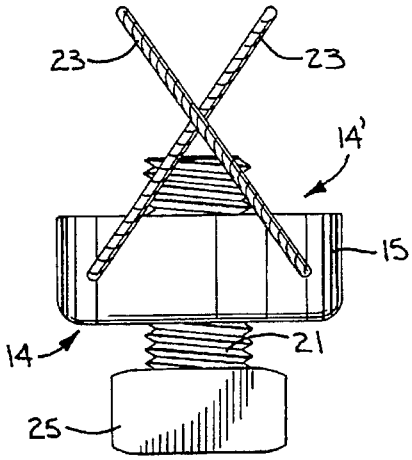
FIG. 3 is an enlarged side view of the baseball batting training device shown in FIG. 1.
Figure 4:
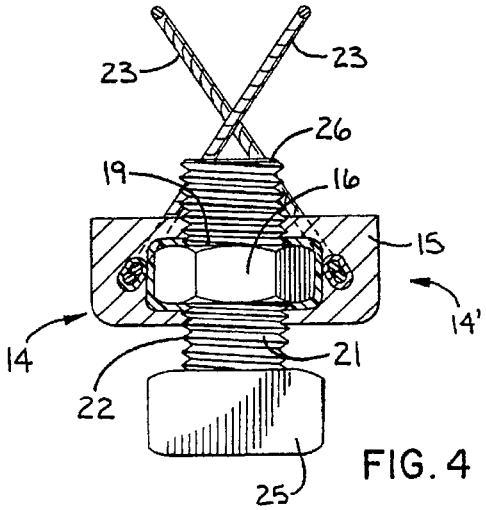
FIG. 4 is an enlarged cross section of my baseball batting training device taken on the line 4—4 looking in the direction indicated by the arrows as seen in FIG. 2.
Figure 10:
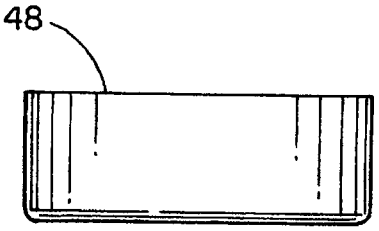
FIG. 10 is a side view of a circular blank steel for use in the manufacture of a second embodiment of my baseball batting training device.
Figure 11:
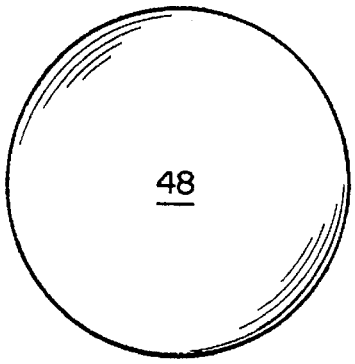
FIG. 11 is a top plan view of the blank in FIG. 10.
Figure 12:
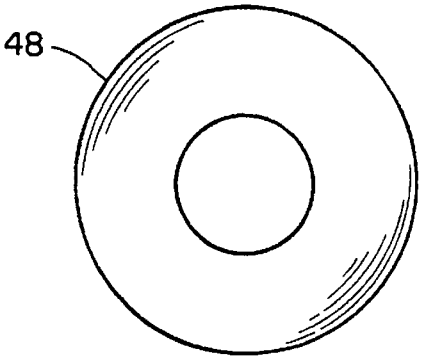
Figure 13:
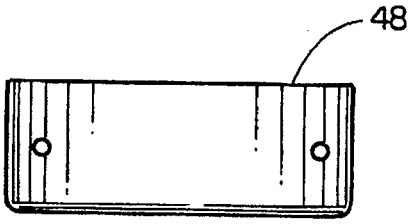
FIG. 13 is a side view of the blank in FIG. 12 with wire holes provided in an exterior circumferential surface.
Figure 14:
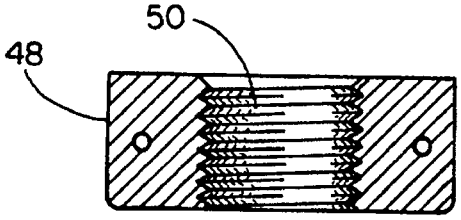
FIG. 14 is a cross section view through out the blank in FIG. 12 with the hole having screw threads.
Figure 15:
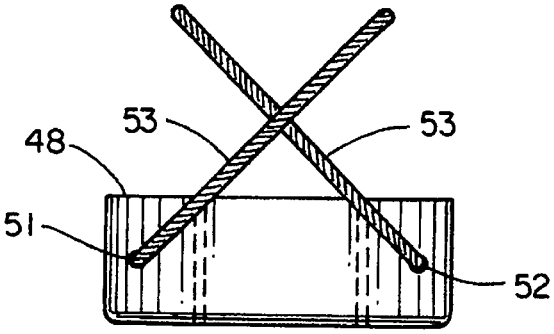
FIG. 15 is a side view of the blank in FIG. 14 only with attachment wires mounted on the weight and secured in the circumferential spaced holes by means of spot welds.
Figure 17:
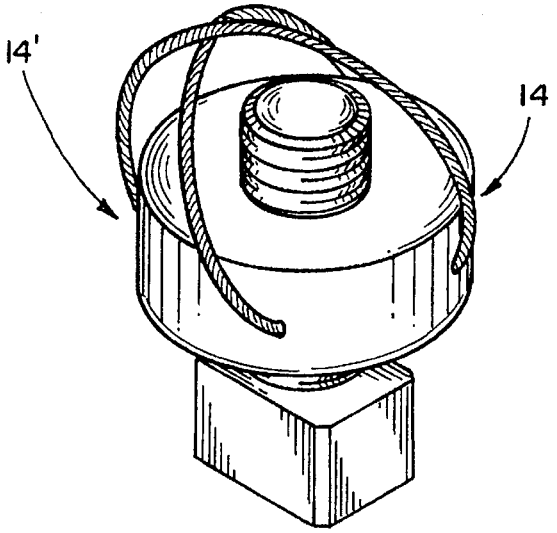
FIG. 17 is a perspective view of the second embodiment of my baseball batting training device shown in FIG. 16.
Figure 16:
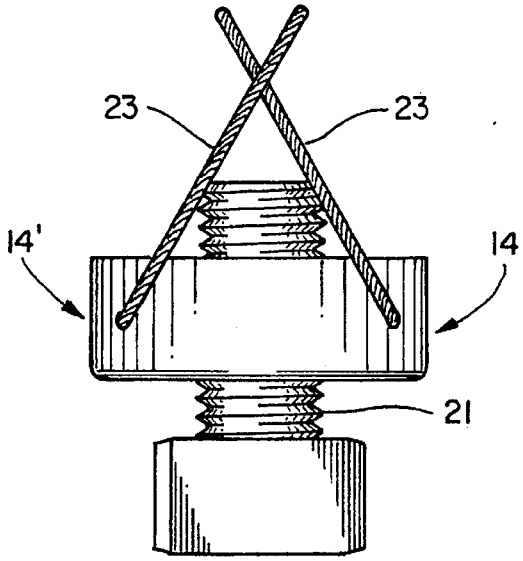
FIG. 16 is a side view of the second embodiment of my baseball batting training device with a threaded bolt secured in assembly made in accordance with the teaching shown in FIGS. 10–15 inclusive.
Figure 18:
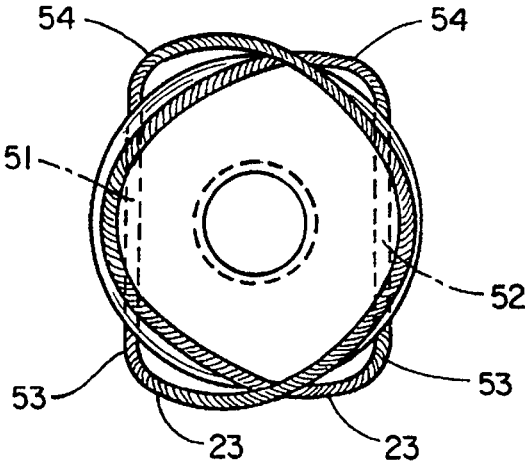
FIG. 18 is a top plan view of the device shown in FIG. 17.
Figure 19:
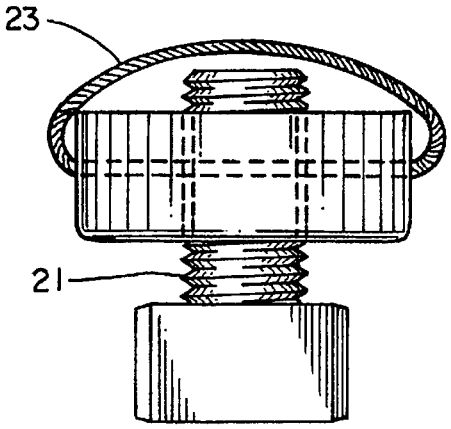
FIG. 19 is another side view of the second embodiment of my baseball batting training device similar to FIG. 16, only as viewed at right angles to the device shown in FIG. 16.
Figure 20:
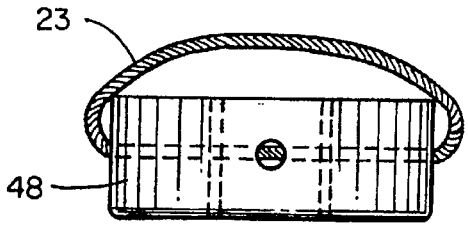

Also provided upon the training device 14 are a pair of annular ring shaped members 23,23 which are formed in integral assembly with the weight 15 as will be hereafter described in further details. The annular members 23,23 are extended away from the weight in a crossed pattern as shown in FIG. 2 and are positioned in engagement with axially facing surface areas 24,24 on the knob 12 of the bat 11.

The bolt 21 has an enlarged head 25 which can be manually turned to cause the external threads 22 to move axially of the threaded bore 19 of the nut 16 for tightening engagement of a lead end 26 of the bolt 21 against the knob 12. The bolt is rotatable in a reverse direction to release the tension between the bolt 21 and the knob end 12 of the bat 11 to enable the annular members 23,23 to be progressively relieved of tension forces for allowing annular members 23,23 to be detached from engagement with the knob 12 of the bat 11. Preferably, the enlarged head 25 of bolt 21 is rounded, as shown in FIG. 24.

The annular members 23,23 are preferably comprised of woven steel rings or members. Opposite ends of each of the rings are secured together by means of a clamp 27 so that the rings cannot be readily pulled out of the weight 15 when formed in embedded assembly during the manufacture process for forming the weight.

In order to secure the baseball batting training device 14 to the baseball bat, the annular members 23,23 are moved into proximity to an opposing annular rim of the knob 12 and the bolt 21 is tamed at its enlarged head 25 to cause the external threads 22 to move axially toward the bat in the threaded bore 19 until the lead end 26 of the bolt 21 engages the knob end of the bat whereupon the annular members 23,23 are progressively drawn taut as the threaded bolt 21 is further tighten by turning of the head end. Once the annular members 23,23 are drawn taut against the knob then further adjustment can be discontinued as the baseball training device 14 should then be firmly secured to the baseball 11. As stated before, by using clamps to secure the ends of the annular members 23,23, resistance forces can be set up to prevent the annular members from being disengaged from the weight 15. By providing a nut 16 which is embedded in the weight 15 where the nut is made of steel thus providing threads of greater strength, the life of the baseball training device 14 can be extended. It was found that where threads were formed in the lead weight that the life of the baseball training device was materially reduced.

Referring now to an alternative embodiment illustrated in FIGS. 10–19, a circular blank steel or weight 48 is circular in shape and formed from a single piece of metal. The weight 48 has a threaded bore 50. A bolt 21, similar to the one previously described, has external threads and is threadingly engaged through the threaded bore 50. Annular members 23,23 are connected to the weight 15 so that the annular members are extended away from the weight in a crossed pattern and are positioned in engagement with axially facing surface areas of said knob of the baseball bat. As previously described, the bolt 21 exerts a pulling force against the pair of annular members engaged against the axially facing surface areas of the knob to hold the baseball batting training device in fixed engagement with the knob of the baseball bat.

The weight 48 has a pair of wire holes referred to as first aperture 51 and second aperture 52. The first aperture 51 extends through the weight perpendicular to the threaded bore 50 on one side of the weight. The second aperture 52 extends through the weight 48 parallel to the first aperture 51 on another side of the weight. The annular members 23,23 have a first end 53 and a second end 54. The first end 53 of one annular member is inserted into one end of the first aperture 51 and the second end 54 of that annular member is inserted into the other end of the first aperture 51. The first end 53 of the other annular member is inserted into one end of the second aperture 52 and the second end 54 of that annular member is inserted into the other end of the second aperture 52. These points of insertion are then spot welded to secure the annular members 23,23 to the weight. However, it is to be understood that other forms of securement such as adhesive and liquid metal could equally be used.

Figure 21:
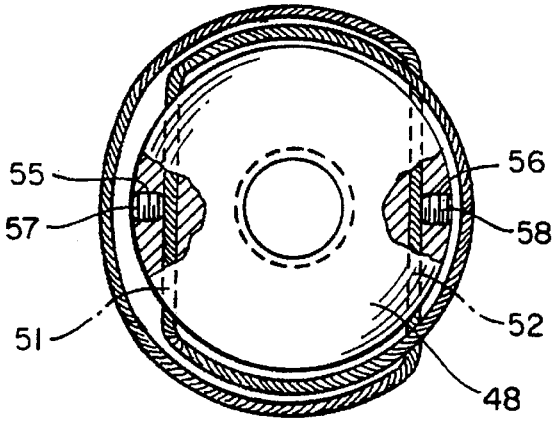
FIG. 21 is a top plan view of the device shown in FIG. 20, having a threaded screw hole drilled there through and a pair of set screw holes drilled there through on two sides of the circular blank of steel.
Figure 22:
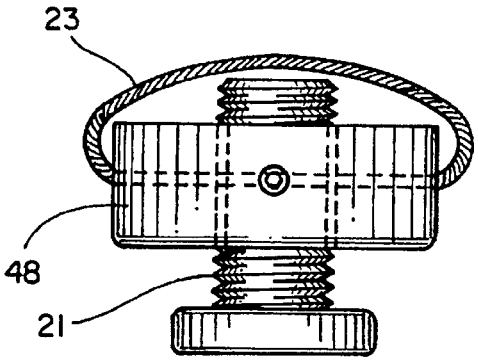
FIG. 22 is a side view of the third embodiment of my baseball batting training device similar to that shown in FIG. 20, now with a threaded bolt secured in assembly made in accordance with the teaching shown in FIGS. 21 and 22 inclusive.
Figure 23:
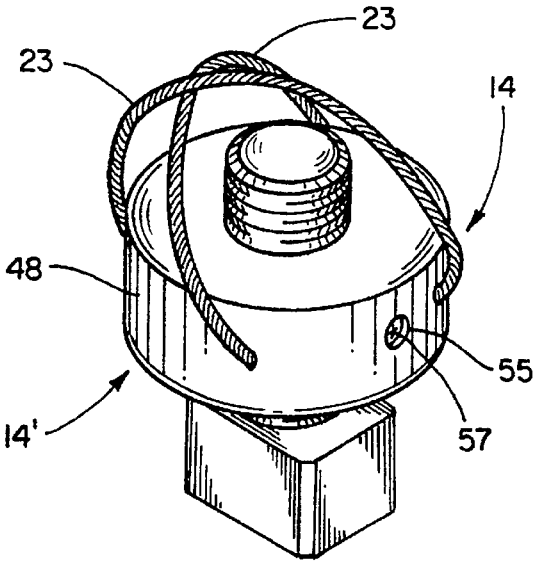
FIG. 23 is a perspective view of the device shown in FIG. 22.
Figure 29:
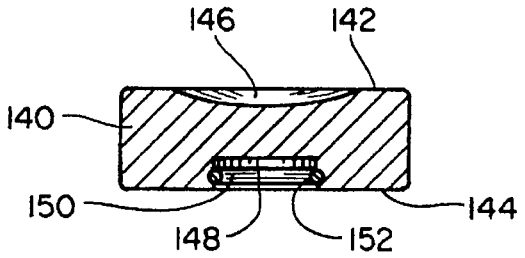
FIG. 29 is a side view of a weight of the fourth embodiment.
Figure 30:
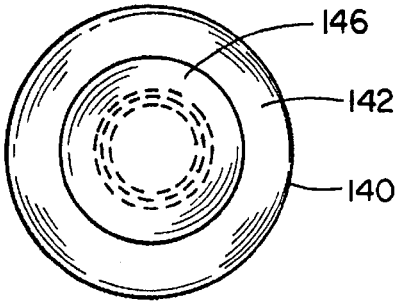
FIG. 30 is a top view of the weight of FIG. 29.
Figure 31:
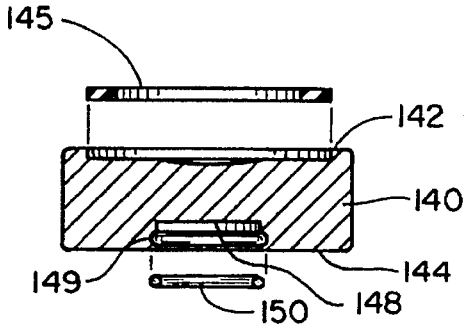
FIG. 31 is a side view of a weight of the fourth embodiment having an annual ring secured to a knob engaging surface.
Figure 32:
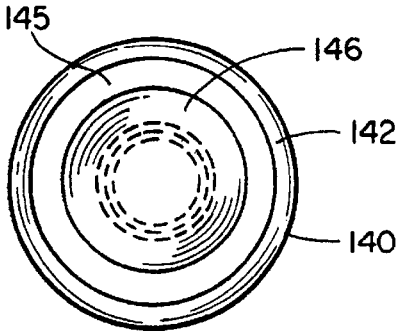
FIG. 32 is a top view of the weight of FIG. 31.

Referring now to FIGS. 20–23, yet another alternative embodiment is shown. A weight 48 is provided which is similar to that shown in FIGS. 10–14. The weight has a first aperture 51 and a second aperture 52. However, the first aperture 51 and second aperture 52 have a diameter greater than that shown before to accommodate the thickness of two wires so that the first end and second end of one annular member can be inserted into the first aperture in lapped relationship, as best shown in FIG. 21. The first end and second end of the other annular member is inserted into the second aperture 52 in a similar lapped relationship.

The weight has a first threaded screw bore 55 perpendicular to and in communication with the first aperture 51 and a second threaded screw bore 56 perpendicular to and in communication with the second aperture 52. A first set screw 57 is inserted or screwed in threaded engagement within the first threaded screw bore 55 and in pressing engagement with the first end and the second end of one annular member so that the annular member is tightly secured to the weight. A second set screw 58 is inserted or screwed in threaded engagement within the second threaded screw bore 56 and in pressing engagement with the first end and the second ends of the other annular member.

Referring now to FIGS. 24–38, a fourth embodiment of my baseball practice device 14 is shown, which is a preferred embodiment of the present invention. The device 14 is secured at one end of the baseball bat, as illustrated in FIG. 24, in a fashion similar to that previously described. It is contemplated that this training device 14 can be easily attached and removed from a knob end of the bat 11 by the user and is further adapted to have removable weights secured to the device allowing a user to selectively train with a desired mass. Similar to the previously discussed embodiments, the device 14 generally includes a structure 14' mounted to a bolt for rotation therewith. The structure 14' includes a weight sized for positioning in co-axial assembly with the knob of the baseball bat. A pair of annular members are attached to the structure.

Figure 34:
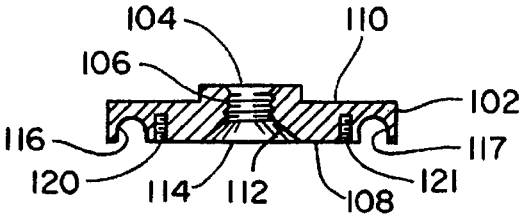
FIG. 34 is a sectional view of the plate taken along line 34—34 of FIG. 33.

The structure includes a circular plate member 102 formed of brass or any other suitable material. The plate member 102 has an axial bore 104 having internal threaded surfaces 106, as best illustrated in FIG. 34. The plate member 102 has an upper plate surface 108 and a lower plate surface 110. Preferably, the upper plate surface 108 has an indented aperture or countersink 112 radially extending around an open end 114 of the bore 104 and in coaxial alignment with the bore 104, as shown in FIGS. 25 and 27.

Figure 33:
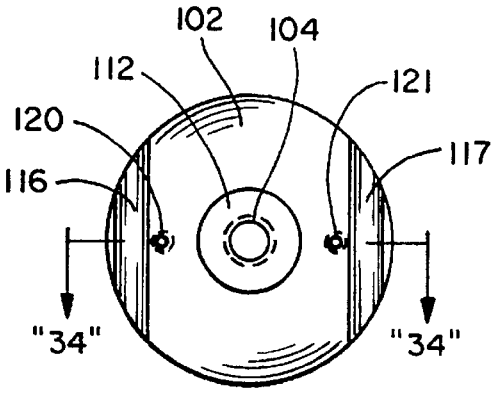
FIG. 33 is bottom view of the of plate of the fourth embodiment having a pair of spaced apart ring receiving grooves.

The lower plate surface 110 of the plate member 102 has a pair of laterally spaced apart grooves 116, 117 for receiving a respective annular member 118, 119. As shown in FIGS. 33 and 34, the grooves 116, 177 are substantially parallel to one another and disposed on opposite sides of the bore 104. A pair of threaded screw bores 120, 121 are disposed on the lower plate surface 110 perpendicular and adjacent to respective grooves 116, 117.

A pair of mounting screws 122, 123 are provided for holding the annular members 118, 119 in secured assembly within respective grooves 116, 117. The screws 122, 123 have enlarged radially extending screw heads 124, 125. Each screw 122, 123 is threadingly engaged into a respective screw bore 120, 121 with the screw heads 124, 125 extending over a respective groove 116, 117 in pressing engagement with a respective annular member 118, 119 to secure the annular members 118, 119 in the grooves 116, 117, as best illustrated in FIG. 27.

The annular members 118, 119 of the structure 14' are similar to those previously described. Crimps 126 of conventional design are used to secure the opposite ends of the wireloops or woven steel rings together encasing the cut wirings and hold the ends firmly together to form an annular member. A cylindrically shaped plastic sleeve 128 encases the crimps 126 and the ends of the wires so that any stray wires extending beyond the crimps 126 will also be encased in the plastic sleeve 128 so that a person using the device will not be apt to be injured with any stray wires. The plastic sleeves 128 are of sufficient length so that they extend beyond the radius of the circular member 102 to minimize wear against the wire or annular members so that it will be less likely that the wire will be damaged through heavy use. As shown in FIG. 27, the sleeves 128 have sleeve ends 129 projecting beyond the grooves of the plate member.

Referring to FIG. 37, a bolt 130 is provided having an enlarged head 132 and a radially extending flange 134. The enlarged head 132 and flange 134 may be threadingly engaged to opposite ends of the bolt 130 or formed integral with the bolt 130. Preferably, outer circumferential sides 136 of the enlarged head 132 of the bolt 130 are knurled or textured to make manual turning easier, as shown in FIG. 28.

The bolt 130 is extended through the bore 104 with external threads or surfaces 138 of the bolt 130 threadingly engaging the internal threads or threaded surfaces 106 of the plate member 102. The flange 134 of the bolt 130 is removably secured to a removable weight 140 in coaxial alignment with the weight 140. The removable weight of the structure 14' is formed of metal or plastic and is of a desired mass so that a range of weights 140 are available to a user allowing the user to easy remove and replace a weight 140 for one of a different mass.

Referring to FIGS. 29–32, the weight 140 has an upper surface 142 and a lower surface 144. The upper surface 142 preferably has a circular concave surface 146 for improve securement against the rounded surface of the knob end of the bat in comparison to a flat upper surface 142 shown in FIGS. 35 and 36. In an alternative weight construction shown in FIGS. 31 and 32, a thin ring member 145 formed of rubber or any other suitable material may be secured to the upper surface 142 within an annular groove 147 disposed around a perimeter of the concave surface 146 in axial alignment with the surface 146 to provide a protective cushion to the knob end of the bat when the device is secured, as well as to reduce vibrations to the device 14 from the bat and to provide additional frictional type forces to prevent lateral movement of the device 14 when secured.

An axially aligned circular bore 148 is provided on the lower surface 144 of the weight 140. The bore having a O-ring slot 149 around a circular side wall of the bore 148 sized for receiving a flexible nylon O-ring 150 to allow an inner curved surface 152 of the O-ring 150 to project radially inwardly into the bore 148, as shown in FIG. 28. The flange 134 of the bolt 130 is inserted through the bore 148 with outer circular edges 154 of the flange 134 being pressed past the curved surface 152 of the O-ring 150 to secure the flange 134 within the bore 148 in a snap fit engagement. It should be understood that other manners of attachment may also be employed.

As previously described with the other embodiments, the bolt exerts a pulling force against the pair of annular members engaged against the axially facing surface areas of the knob to hold the baseball batting training device in fixed engagement with the knob of the baseball bat. In this embodiment, the weight 140 is pushed against the knob of the bat as the bolt 130 is tightened allowing plate member 102 and weight 140 to separate causing the annular members 118, 119 to become taut.

Another part of my invention involves my method of manufacture of the baseball bat training device for attachment to the knob end of a baseball bat. In this connection I have developed a die or mold 40 for manufacture of my baseball training device 14, as shown in FIGS. 5–9. The main part of the mold is a cup shaped member having a cup shaped mold cavity 41 with a central opening 42 which is threaded at 43. An upper rim 44 of the cup-shaped member has two pairs of slots 45, 45 and 46, 46 which are on opposite sides of the rim 44 and which confront one another. These slots are machined to provide resting places for the annular members 23, 23, which comprise wires that are to be placed in the mold 40 during the molding operation for securement with the lead weight 15 that forms a part of the baseball batting training device 14.

It is significant that the annular members or wires 23, 23 that have their ends clamped together have a length of seven (7) inches in one preferred embodiment. By providing the annular members or rings 23, 23 having an initial length of seven inches, and by embedding parts of the wire rings 23, 23 in the mold 40, there is enough wire to encompass the knob 12 of the bat and then the threaded bolt can be threaded into the center section of the weight with a lead end of the bolt then engaged against the knob end of the bat to spread the wires taught to secure the assembly in engagement with the bat.

Returning to the description of the molding procedure for the manufacture of my baseball batting training device 14, it will be observed that a longer threaded die bolt 47 than the one that is actually used on the weighted practice device is used for the molding of the lead weight 15. The reason a longer bolt is used involves a need for a longer shank so that when the molding process is about to commence and everything is in readiness for receipt of the molten lead, the upper end of the threaded bolt 47 will project high enough so that it will not interfere with the pouring procedure of the molten lead into the cavity of the mold 40.

A close fit is needed between the shank of this bolt 47 and the opening 42 in the bottom of the cup shaped mold. However, no threads are necessary and that molding procedure can be completed without the threads.

It will also be appreciated that the mold described is designed to provide a way for manufacture of the prototype of this embodiment, but that in final manufacturing procedures, the mold will be refined. To this end, the slots will be better aligned at the open end of the socket and not offset as they are now shown.

In the molding operation, it will be appreciated that the steel threaded nut 16 that is to be embedded within the molded lead is threaded down on the shank on the threaded bolt to such a point that it is in spaced relationship with respect to the bottom of the mold cavity so that when the lead is poured, the steel nut will be exteriorly encased by the lead except at the area where the bolt is threaded through the center of the nut. Once the lead is poured into the mold, it will also envelope segments of the wire rings so that these wire rings will also be permanently adhered within the lead casting. It is in this way that the two rings and the steel nut are embedded within the lead to complete the formation of the components forming this device.

Once the molten lead has cooled, the lead becomes hard and the molded product can be knocked from the mold after the threaded bolt is unthreaded from the nut by using another tool and a hammer to disengage the molded lead casting from the mold.

At this point in time, the molded product must then be cleaned and a file can be used to smooth the edges of the lead where required. Then the product can be painted with a plastic paint of suitable type.

It should also be noted that preferably the size of the diameter of the shank of the bolt is ¾" instead of ⅝", for example. This provides a greater tip end area for engagement of the bolt against the knob end of the bat to resist wobble and movement of the weight when it is attached to the bat. The length of the ¾" bolt would be 1½".

In summary, the method of manufacturing a baseball batting training device as described above and best shown in FIGS. 5–9, comprises the steps of: forming a mold having a cup shaped mold cavity, the mold having a threaded bore at a bottom side of the mold in communication with the mold cavity; threading a bolt through the mold in threaded engagement with the threaded bore; threading an internally threaded nut on the bolt so that the nut is within the cup shaped mold cavity in a spaced apart relationship with a mold cavity bottom of the cup shaped mold cavity; forming a pair of annular members by clamping opposite ends of a pair of wires with clamps; inserting the clamps of the annular members into the cup shaped mold cavity so that a clamp of each annular member is on either side of the bolt; and pouring a molten lead in the cup shaped mold cavity to envelope the clamps and an outside surface of the nut to create a molded product.

Once the molten lead has cooled to form the molded product, which makes up the weight 15, the method comprises the additional steps of removing the molded product from the mold, cleaning and filing the molded product so that there are not any rough surfaces or edges, and painting the molded product with a paint of suitable type, such as a plastic or rubberized paint.

A method of manufacturing the baseball batting training device shown in FIGS. 10–23, comprises the steps of: forming a circular weight from any type of conventional forming method, such as with a stamping machine; drilling and tapping a threaded bore through the weight; drilling a first aperture extending through the weight perpendicular to the threaded bore on one side of the weight; drilling a second aperture extending through the weight parallel to the first aperture on another side of the weight; threading a bolt through the threaded bore of the weight; and attaching a pair of annular members to the weight so that the annular members are attached on either sides of the bolt;

The step of attaching a pair of annular members to the weight so that the annular members are attached on either sides of the bolt is different for the embodiment shown in FIGS. 15–19 than from the embodiment shown in FIGS. 20–23.

Referring to the method of manufacturing the embodiment shown in FIGS. 15–19, the step of attaching comprises the steps of: attaching the first end of one annular member to one end of the first aperture and attaching the second end of that annular member to another end of the first aperture; and attaching the first end of another annular member to one end of the second aperture and attaching the second end of that annular member to another end of the second aperture. These steps of attaching preferably include the step of spot welding. However, other forms of securement, such with adhesive or liquid metal, could also be used.

Referring to the method of manufacturing the embodiment shown in FIGS. 20–23, the step of attaching comprises the steps of: inserting the first end and second end of one annular member in lapped relationship within the first aperture; inserting the first end and second end of the other annular member in lapped relationship within the second aperture; and securing the lapped first end and second end of the annular members within the corresponding first aperture and second aperture.

Preferably, the step of securing the lapped first end and second end of the annular members within the corresponding first aperture and second aperture, comprises the steps of: drilling and tapping a first threaded screw bore into the weight perpendicular to and in communication with the first aperture; drilling and tapping a second threaded screw bore perpendicular to and in communication with the second aperture; inserting a first set screw in threaded engagement within the first threaded screw bore and in pressing engagement with the first end and the second end of one annular member; and inserting a second set screw in threaded engagement within the second threaded screw bore and in pressing engagement with the first end and the second end of the other annular member. The weight may then be painted with a paint of suitable type.

Under the current rules of baseball it is forbidden to use a baseball batting device of the type described during a regulation game. If the device were used in a game, for example, there might be some tendency for the wire rings to become partially disengaged or distorted in position and hence usage of this device is not intended for game conditions. It is intended to be a device used by a player during a practice session with his or her instructor. Thus, this device can be used during training sessions by a player to aid in improving his or her baseball batting swing, and ultimately aimed towards the end of increasing the velocity of the bat head at the point of impact with the ball. In a typical training procedure, the instructor will observe the player making practice swings with the training device at the end of the bat, to attempt to instruct the player in proper techniques in the execution of the batting swing. In the course of this training procedure, the instructor may elect to have a ball put on a practice tee, or throw the ball vertically upward and have the player strike the ball with the training device on the bat.

In operation, the top hand on the baseball bat is the power hand. When you swing with a conventional weight located at the sweet spot of the bat, you start your swing and lead the bat with your hands. As you swing through, the inertia starts to push the bat away from your hands and thus your top hand is not transferring much power or snap to the bat when it impacts a ball. By using the baseball batting training device at the knob of the bat, you swing the bat and you lead with your hands but the bat does not create the usual inertial force away from your hands. Now, your top hand has to push the head of the bat to transfer power or snap to the bat to make it impact a ball. By training with this device you build up your top hand and arm muscles. Thus, after having trained with a baseball batting training device, when you swing a bat without the baseball batting training device attached to your bat you will swing the bat with more bat head speed. Finally, this device can be used on either wooden bats or aluminum bats, as desired.

The foregoing discussion discloses and describes merely exemplary embodiments of the present invention. One skilled in the art will readily recognize from such discussion, and from the accompanying drawings and claims, that various changes, modifications, and variations can be made without departing from the spirit and scope of the invention as defined in the following claims.

I claim:

1. In combination, a baseball bat with a knob at one end, and a baseball batting training device comprising a weight sized for positioning in co-axial assembly with the knob of the baseball bat, a plate member having an axial bore, the bore having internal threads, a bolt with external threads in threaded engagement with the internal threads of the bore, a pair of annular members attached to the plate member, the annular members extending away from the plate member in a crossed pattern and being positioned in engagement with axially facing surface areas of said knob of the baseball bat, the weight being removably connected to the bolt, the bolt, when rotated, exerting a pulling force against the pair of annular members engaged against the axially facing surface areas of said knob to hold the baseball batting training device in fixed engagement with the knob of said baseball bat.

2. The combination of claim 1, wherein the bolt has an enlarged head that can be manually turned to cause the external threads to move axially of the bore of the plate member for tightening the engagement of an upper surface of the weight against the knob, the bolt being rotatable in a reverse direction to release the tension between the weight and the knob end of the bat to enable the annular members to be progressively relieved of tension forces for allowing the crossed annular members to be detached from engagement with the knob of the baseball bat.

3. The combination of claim 1, wherein the weight has an upper surface, the upper surface having a concave surface for securement against the knob end of the bat.

4. The combination of claim 3, further comprising a ring member secured to the upper surface around a perimeter of the concave surface.

5. The combination of claim 1, wherein the plate member has a pair of laterally spaced apart grooves on a lower plate surface of the plate member, the plate member has a pair of threaded screw bores disposed on the lower plate surface perpendicular and adjacent to respective grooves which receive a pair of mounting screws, the mounting screws having screw heads extending over a respective groove in pressing engagement with a respective annular member.

6. The combination of claim 5, wherein the annular members are comprised of woven steel members, crimp means attaching opposite ends of the woven steel members to secure the ends of each of the members in an annular configuration, and a sleeve encasing the ends of each of the members.

7. The combination of claim 6, wherein each sleeve is engaged within a respective groove, the sleeve having sleeve ends projecting beyond the grooves of the plate member to minimize wear against annular members.

8. The combination of claim 1, wherein the weight is of a round circular configuration having a diameter slightly smaller than an outer diameter of the knob of the baseball bat.

9. The combination of claim 1, wherein a lower surface of the weight has a circular bore, a circular side wall of the bore having an O-ring slot which receives an O-ring, a flange of the bolt being removably secured within the circular bore with the O-ring in pressing engagement with the flange.

10. A baseball bat practice device, comprising: a weight sized for positioning in co-axial assembly with a knob of a baseball bat, a plate member having an axial bore, the bore having internal threads, a bolt with external threads in threaded engagement with the internal threads of the bore, a pair of annular members attached to the plate member, the annular members extending away from the plate member in a crossed pattern and adapted to be positioned in engagement with axially facing surface areas of said knob of the baseball bat, means for removably securing the weight to the bolt, the bolt, when rotated, adapted to exert a pulling force against the pair of annular members engaged against the axially facing surface areas of said knob to hold the baseball bat practice device in fixed engagement with the knob of said baseball bat.

11. The device of claim 10, wherein the bolt has an enlarged head adapted to be manually turned to cause the external threads to move axially of the bore of the plate member for tightening the engagement of an upper surface of the weight against the knob, the bolt adapted to be rotatable in a reverse direction to release the tension between the weight and the knob end of the bat to enable the annular members to be progressively relieved of tension forces for allowing the crossed annular members to be detached from engagement with the knob of the baseball bat.

12. The device of claim 10, wherein the weight has an upper surface, the upper surface having a concave surface adapted for securement against the knob end of the bat, and a ring member secured to the upper surface around a perimeter of the concave surface.

13. The device of claim 12, wherein the plate member has a pair of laterally spaced apart grooves on a lower plate surface of the plate member, the plate member has a pair of threaded screw bores disposed on the lower plate surface perpendicular and adjacent to respective grooves receiving a pair of mounting screws, the mounting screws having screw heads extending over a respective groove in pressing engagement with a respective annular member.

14. The device of claim 13, wherein the annular members are comprised of woven steel members, crimp means attaching opposite ends of the woven steel members to secure the ends of each of the members in an annular configuration, and a sleeve encasing the ends of each of the members, each sleeve engaging a respective groove, the sleeve having sleeve ends projecting beyond the grooves of the plate member to minimize wear against annular members.

15. The device of claim 10, wherein the means for removably securing the weight to the bolt includes a lower surface of the weight having a circular bore, a circular side wall of the bore having an O-ring slot which receives an O-ring, a flange of the bolt being removably secured within the circular bore with the O-ring in pressing engagement with the flange.

16. A baseball bat practice device, comprising: a structure mounted to a bolt for rotation therewith, the structure including a weight sized for positioning in co-axial assembly with a knob of a baseball bat, the structure having a plate member, the plate member having an axial bore with internal threads, the bolt having external threads in threaded engagement with the internal threads of the bore, a pair of annular members attached to the plate member, the annular, members extending away from the structure in a crossed pattern with each other and adapted to be positioned in engagement with axially facing surface areas of said knob of the baseball bat, the bolt, when rotated, adapted to exert a pulling force against the pair of annular members engaged against the axially facing surface areas of said knob to hold the baseball bat practice device in fixed engagement with the knob of said baseball bat.

17. The device of claim 16, wherein the bolt has an enlarged head adapted to be manually turned to cause the external threads to move axially of the bore of the plate member for tightening the engagement of an upper surface of the weight against the knob, the bolt adapted to be rotatable in a reverse direction to release the tension between the weight and the knob end of the bat to enable the annular members to be progressively relieved of tension forces for allowing the crossed annular members to be detached from engagement with the knob of the baseball bat.

18. The device of claim 17, wherein the weight has an upper surface, the upper surface having a concave surface adapted for securement against the knob end of the bat, and a ring member secured to the upper surface around a perimeter of the concave surface.

19. The device of claim 17, wherein the annular members are comprised of woven steel members, crimp means attaching opposite ends of the woven steel members to secure the ends of each of the members in an annular configuration, and a sleeve encasing the ends of each of the members, each sleeve engaging a respective groove, the sleeve having sleeve ends projecting beyond the grooves of the plate member to minimize wear against annular members.

20. The device of claim 16, further comprising means for removable securing the weight to one end of the bolt.

* * * * *